US007839360B2

(12) United States Patent
Lim

(10) Patent No.: US 7,839,360 B2
(45) Date of Patent: Nov. 23, 2010

(54) METHOD OF DRIVING PLASMA DISPLAY PANEL AND APPARATUS THEREOF

(75) Inventor: Geun Soo Lim, Kyonggi-do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 11/653,247

(22) Filed: Jan. 16, 2007

(65) Prior Publication Data

US 2007/0115218 A1 May 24, 2007

Related U.S. Application Data

(63) Continuation of application No. 10/950,666, filed on Sep. 28, 2004, which is a continuation of application No. 10/145,375, filed on May 14, 2002, now Pat. No. 6,906,690.

(30) Foreign Application Priority Data

May 15, 2001 (KR) ..... 2001-26308

(51) Int. Cl.
*G09G 3/28* (2006.01)

(52) U.S. Cl. ..... 345/63

(58) Field of Classification Search ..... 345/55, 345/60, 61, 62, 63, 67, 68; 313/582–587
See application file for complete search history.

(56) References Cited

U.S. PATENT DOCUMENTS 5,654,728 A 8/1997 Kanazawa et al. ..... 345/68
5,663,741 A * 9/1997 Kanazawa ..... 345/66
6,020,687 A * 2/2000 Hirakawa et al. ..... 385/135
6,037,916 A * 3/2000 Amemiya ..... 345/60
6,111,556 A 8/2000 Moon ..... 345/60
6,144,348 A 11/2000 Kanazawa et al. ..... 345/60
6,249,087 B1 * 6/2001 Takayama et al. ..... 315/169.1

(Continued)

FOREIGN PATENT DOCUMENTS

EP 1 065 646 A3 4/2002

(Continued)

OTHER PUBLICATIONS

Office Action dated Jan. 7, 2010 for U.S. Appl. No. 10/950,666.

(Continued)

*Primary Examiner*—Chanh Nguyen
*Assistant Examiner*—Pegeman Karimi
(74) *Attorney, Agent, or Firm*—Ked & Associates, LLP

(57) ABSTRACT

Disclosed is a method of driving a plasma display panel and apparatus thereof enabling to minimize power consumption for driving the plasma display panel. 1. The present invention includes the steps of generating a reset discharge by supplying ramp waves so as to equalize cells in the plasma display panel in a reset period, supplying selected specific ones of the cells with a scan voltage pulse swinging between a lowest voltage levels of the reset discharge and a data pulse of a voltage level lowered as much as a negative voltage level of the scan voltage pulse, generating an address discharge by the scan voltage pulse and data pulse applied to the selected cells in an address period, and maintaining the address discharge for a sustain period.

22 Claims, 5 Drawing Sheets

U.S. PATENT DOCUMENTS

| | | | | |
|---|---|---|---|---|
| 6,256,001 | B1 | 7/2001 | Kim et al. | 345/60 |
| 6,294,875 | B1 | 9/2001 | Kurata et al. | 315/169.1 |
| 6,411,268 | B1 | 6/2002 | Nakamura et al. | 345/60 |
| 6,414,653 | B1 * | 7/2002 | Kobayashi | 345/60 |
| 6,456,263 | B1 | 9/2002 | Hashimoto et al. | 345/60 |
| 6,483,251 | B2 | 11/2002 | Setoguchi et al. | 315/169.4 |
| 6,567,059 | B1 | 5/2003 | Ide et al. | 345/60 |
| 6,580,217 | B2 * | 6/2003 | Kim et al. | 313/582 |
| 6,597,334 | B1 | 7/2003 | Nakamura | 345/68 |
| 6,603,447 | B1 | 8/2003 | Ito et al. | 345/60 |
| 6,642,663 | B2 | 11/2003 | Okamura et al. | 315/169.3 |
| 6,686,912 | B1 | 2/2004 | Kishi et al. | 345/211 |
| 6,707,436 | B2 | 3/2004 | Setoguchi et al. | 345/60 |
| 6,717,557 | B2 | 4/2004 | Ishizuka | 345/60 |
| 6,768,478 | B1 * | 7/2004 | Wani et al. | 345/60 |
| 2001/0017605 | A1 * | 8/2001 | Hashimoto et al. | 345/60 |
| 2002/0167466 | A1 * | 11/2002 | Setoguchi et al. | 345/60 |
| 2002/0186186 | A1 * | 12/2002 | Hashimoto et al. | 345/63 |

FOREIGN PATENT DOCUMENTS

| | | |
|---|---|---|
| JP | 06-289811 | 10/1994 |
| JP | 11-095712 | 9/1999 |
| JP | 2000-293135 | 10/2000 |
| JP | 2001-013911 | 1/2001 |
| KR | 2001-0006823 | 1/2001 |

OTHER PUBLICATIONS

Office Action dated Jul. 30, 2010 for U.S. Appl. No. 11/869,358.
Office Action dated Jul. 30, 2010 for U.S. Appl. No. 11/869,398.
Office Action dated Aug. 2, 2010 for U.S. Appl. No. 11/924,292.

* cited by examiner

METHOD OF DRIVING PLASMA DISPLAY PANEL AND APPARATUS THEREOF

CROSS-REFERENCE TO RELATED APPLICATIONS

This application is a Continuation Application of prior U.S. patent application Ser. No. 10/950,666 filed on Sep. 28, 2004 which is a Continuation Application of prior U.S. patent application Ser. No. 10/145,375 now U.S. Pat. No. 6,906,690 filed on May 14, 2002, which claims priority under 35 U.S.C. §119 to Korean Application Nos. P2001-26308 filed on May 15, 2001, whose entire disclosure is hereby incorporated by reference.

BACKGROUND

1. Field of the Invention

The present invention relates to a plasma display panel, and more particularly, to a method of driving a plasma display panel and an apparatus thereof enabling to minimize power consumption for driving the plasma display panel.

2. Discussion of the Related Art

Generally, a plasma display panel (hereinafter abbreviated PDP) is more advantageous for enlarging its screen size than any other flat board type display devices.

Therefore, PDP gets lots of attention as a large-sized display panel.

PDP, as shown in FIG. 1, is mainly driven by an AC voltage with three electrodes, which is called an AC surface discharge type PDP.

FIG. 1 illustrates a bird's-eye view of a discharge cell in a 3-electrodes AC surface discharge type PDP (AC PDP of surface discharge type having 3-electrodes) according to a related art.

Referring to FIG. 1, a discharge cell in a 3-electrodes AC surface discharge type PDP includes scan and sustain electrodes 12Y and 12Z formed on a front substrate 10 respectively and an address electrode 20X formed on a back substrate 18.

A front dielectric layer 14 and a protective layer 16 are stacked on the front substrate 10 on which the scan and sustain electrodes 12Y and 12Z are formed in parallel with each other. And, wall charges are accumulated on the front dielectric layer 14.

The protective layer 16 prevents the front dielectric layer 14 from being damaged by sputtering generated from plasma discharge as well as increases a discharge efficiency of secondary electrons. And, the protective layer 16 is generally formed of MgO.

On the back substrate 18 having the address electrode 20X, formed are a back dielectric layer 22 and barrier ribs 24. And, phosphors 26 are coated on surfaces of the back dielectric layer 22 and barrier ribs 24.

The address electrode 24 is formed to cross with the scan and sustain electrodes 12Y and 12Z.

The barrier ribs 24 are formed to be in parallel with the address electrode 20X so as to prevent UV and visible rays from leaking in an adjacent discharge cell.

The phosphors 26 become excited by the UV-rays generated from plasma discharge so as to irradiate one of red, green, and blue visible rays. An inert gas for gas discharge is injected in a discharge space provided between the barrier ribs 24 and two substrates 10 and 18.

The above-explained discharge cell is selected by a confronting discharge between the address and scan electrodes 20X and 12Y, and then maintains the discharge state by a surface discharge between the scan and sustain electrodes 12Y and 12Z so as to be at a sustain discharge state.

In PDP, the phosphors 26 emit light so as to discharge visible rays outside the cell. In this case, PDP adjusts a discharge maintaining time, i.e. discharge maintaining time, of the cell in accordance with video data so as to realize a gray scale required for displaying a video.

In such a 3-electrodes AC surface discharge type PDP, a driving time for displaying a specific gray scale of a single frame is divided into a plurality of sub-fields. For each sub-field duration, luminescence is generated in proportion to a count of a weight of the video data so as to carry out a gray scale display.

In order to display such a gray level of a video, a general PDP is driven by an ADS (address and display period separated) system of dividing a single frame into sub-fields having different discharge counts.

For instance, in case that a video is displayed with 256 gray scales using video data of 8 bits, a 1-frame display duration (ex. 1/60 second=about 16.7 msec.) in each discharge cell is separated into eight sub-fields.

And, each of the eight sub-fields is separated into a reset period, an address period, and a sustain period. A time weight is differently given to the sustain period of each of the eight sub-fields in proportion to $2^N$, where N=0, 1, 2, 3, . . . , 7. Namely, each of the time weights of the first to eighth sub-fields increases like a ratio of 1:2:4:8:16:64:128.

Since the sustain periods of the sub-fields become different from each other, the gray scale of the video can be expressed.

FIG. 2 illustrates a graph of driving waveforms applied to electrodes respectively for driving PDP according to a related art.

Referring to FIG. 2, a PDP driving is divided into a rest period initializing discharge cells, an address period generating a selective address discharge in accordance with a logic value of video data, a sustain period maintaining the discharge in the discharge cell from which the address discharge is generated, and an erase period erasing all the discharges maintained in the entire discharge cells. More specifically, the reset period equalizes the states of the entire discharge cells by initializing the discharge cells, the address period selects specific ones of the discharge cells, and the sustain period expresses the gray scale in accordance with the maintaining discharge count.

The reset period is divided into a set-up period and a set-down period. In the set-up period, an ascending ramp wave ramp1 is supplied to the scan electrode 12Y, while a descending ramp wave ramp2 is supplied to the scan electrode 12Y.

During the set-up period, a weak reset discharge is generated by the ascending ramp wave ramp1 so that wall charges are accumulated in the cell.

During the set-down period, the wall charges in the cell are properly erased in part by the descending ramp wave ramp2 so as to be reduced as helping a following address discharge as well as prevent a wrong discharge. Besides, in order to reduce the wall charges, a pulse having a positive (+) DC voltage Va is applied to the sustain electrode 12Z during the set-down period.

Against the sustain electrode 1Z supplied with the pulse of the positive DC voltage Va, the scan electrode 12Y supplied with the descending ramp wave ramp2 becomes negative (−). Thus, inversion of the polarities makes the wall charges, which were generated from the set-up period, are reduced.

During the address period, an address discharge is generated by a pulse of a scan voltage V_scan applied to the scan electrode 12Y and a data pulse applied to the address electrode 20X. The address discharge enables to maintain the previously generated wall charges for a period of other discharge cells to be addressed. In this case, a voltage level of the pulse of the scan voltage V_scan is greater than or equal to a ground potential.

During the sustain period, a trigger pulse TP is initially applied to the scan electrode 12Y. A sustain discharge of the discharge cells having the wall charges sufficiently for the address period is initiated by the trigger pulse TP. Subsequently, sustain pulses SUSP are applied to the scan and sustain electrodes 12Y and 12Z alternately so as to sustain the sustain discharge. Thus, the sustain discharge is maintained so as to display a demanded gray scale.

And, during the erase period, an erase pulse EP is applied to the sustain electrode 12Z so as to stop the sustained discharge. The erase pulse EP has a ramp wave so as to have a small luminescent size as well as has a short pulse width so as to erase the discharge. Since the short erase discharge is generated by the erase pulse EP having such a short pulse width, the charged particles are erased so as to stop the discharge.

In the above-explained driving periods, a sufficiently large quantity of wall charges is formed with the weak discharge using the ramp waves raml and ram2 during the reset period, and the a proper quantity of the wall charges is erased. The erased wall charges are used for the following address discharge.

In other words, the wall charges are formed uniformly on the entire screen for the reset period, thereby enabling to lower the driving voltage required for the address period.

Unfortunately, in the PDP driving has difficulty in reducing the voltage applied to the address electrode 20X for the address discharge.

Specifically, the address voltage required for the address discharge is expressed by the following Formula 1.

[Formula 1]

$V_{address}>V_{f,y-a}-(V_{w,d}+V_{w,y}$, where $V_{address}$, $V_{w,d}$, $V_{f,y-a}$, and $V_{w,y}$ are a address voltage, a wall voltage accumulated on the address electrode 20X, a discharge initiating voltage between the address and scan electrodes 20X and 12Y, and a wall voltage accumulated on the scan electrode 12Y, respectively.

In Formula 1, providing that a minimum point of the scan voltage V_scan, as shown in FIG. 2, is tied to the ground voltage level, the discharge initiating voltage $V_{f,y-a}$ is expressed by the data voltage applied to the address electrode 20X only.

In this case, the discharge initiating voltage Vf,y.a as the data voltage is reduced so as to bringing about the problems such as the wrong discharge and the like.

Since the minimum point of the scan voltage V_scan is limited to the ground voltage level, it is difficult to reduce the data voltage as the discharge initiating voltage of the address discharge.

SUMMARY OF THE INVENTION

Accordingly, the present invention is directed to a method of driving a plasma display panel and apparatus thereof that substantially obviates one or more problems due to limitations and disadvantages of the related art.

An object of the present invention is to provide a method of driving a plasma display panel and an apparatus thereof enabling to overcome a lower limit of a data voltage as an initiating voltage of an address discharge by reducing a voltage of scan pulse to a level lower than a ground potential.

Additional advantages, objects, and features of the invention will be set forth in part in the description which follows and in part will become apparent to those having ordinary skill in the art upon examination of the following or may be learned from practice of the invention. The objectives and other advantages of the invention may be realized~and attained by the structure particularly pointed out in the written description and claims hereof as well as the appended drawings.

To achieve these objects and other advantages and in accordance with the purpose of the invention, as embodied and broadly described herein, a method of driving a plasma display panel according to the present invention includes a first step of generating a reset discharge by supplying ramp waves so as to equalize cells in the plasma display panel in a reset period, a second step of supplying selected specific ones of the cells with a scan voltage pulse swinging between a lowest voltage levels of the reset discharge and a data pulse of a voltage level lowered as much as a negative voltage level of the scan voltage pulse, a third step of generating an address discharge by the scan voltage pulse and data pulse applied to the selected cells in an address period, and a fourth step of maintaining the address discharge for a sustain period.

Preferably, the second step, when the lowest voltage level of the reset discharge is a ground potential, is carried out in a manner that the scan voltage pulse lowered from a positive level to a negative level for the ground potential is applied to the selected specific cells.

In another aspect of the present invention, an apparatus for driving a plasma display panel, the apparatus having scan, sustain, and address electrodes so as to be driven in accordance with reset, address, and sustain periods for time, the apparatus includes a scan driving integrated circuit supplying the scan electrode with inputted positive and negative voltages, a first scan voltage supplying unit supplying the scan driving integrated circuit with a positive voltage higher relatively than a lowest voltage level of a reset discharge, a second scan voltage supplying unit supplying the scan driving integrated circuit with a negative voltage lower relatively than the lowest voltage level of the reset discharge, and an energy recovery unit charging a voltage recovered from the scan electrode in the sustain period so as to discharge the charged voltage.

Preferably, the apparatus further includes a set-up voltage supplying unit supplying the scan driving integrated circuit with a first ramp wave having a voltage level increasing at a first predetermined slope in the reset period and a set-down voltage supplying unit supplying the scan driving integrated circuit with a second ramp wave having the voltage level decreasing to the lowest voltage level at a second predetermined slope in the reset period.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
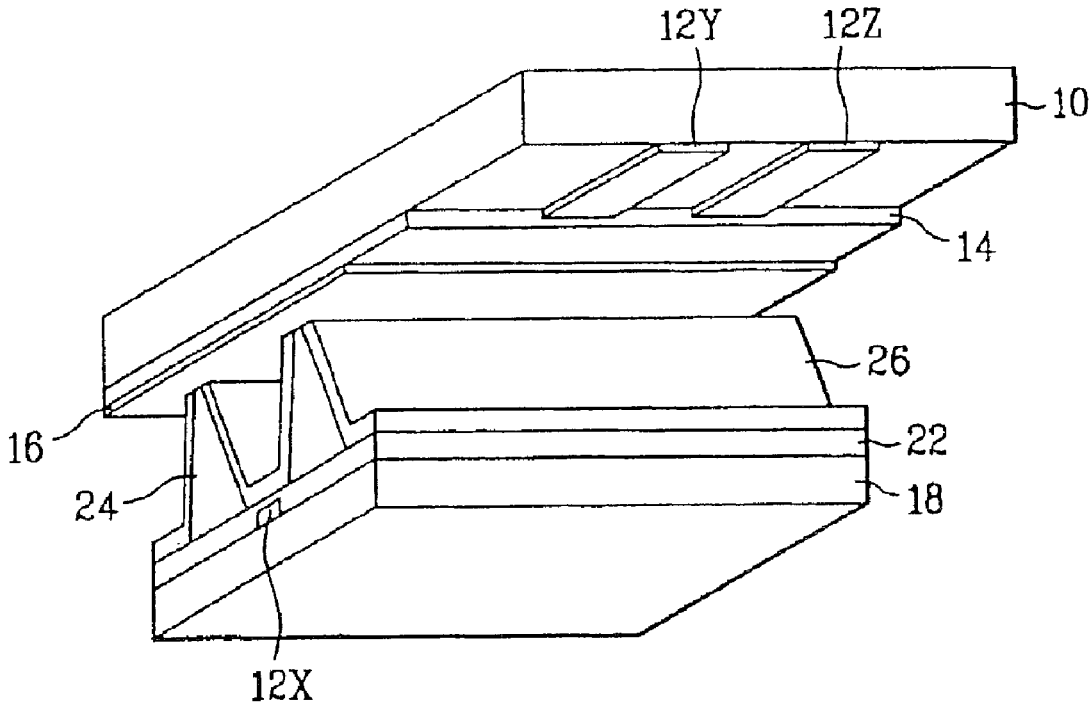
FIG. 1 Related Art
FIG. 1 illustrates a bird's-eye view of a discharge cell in a 3-electrodes AC surface discharge type PDP according to a related art.
Figure 2:
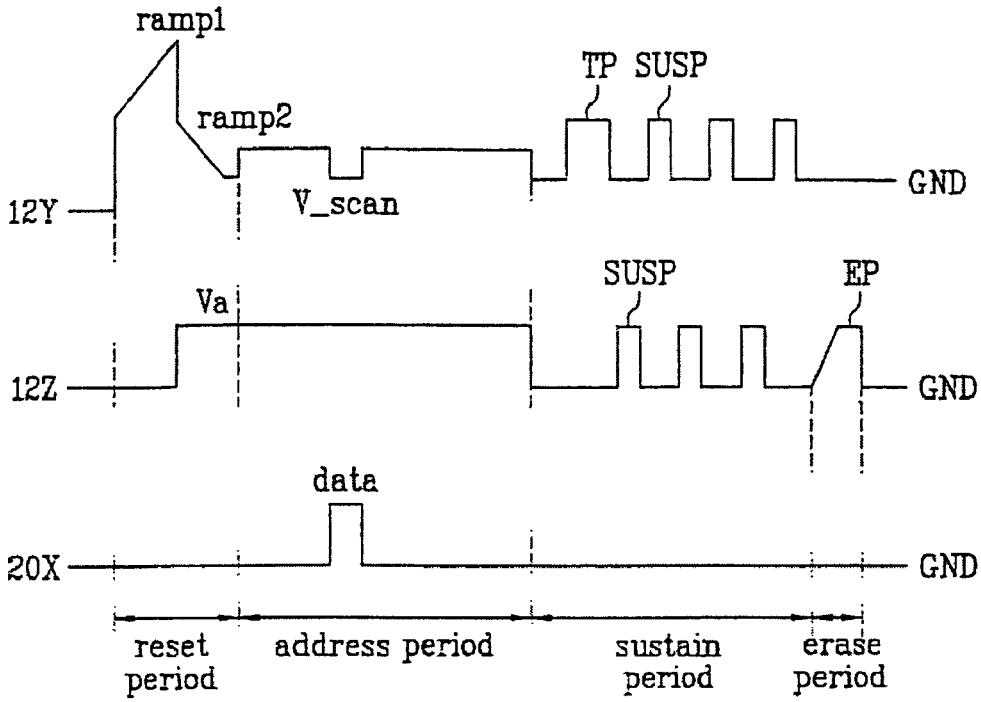
FIG. 2 Related Art
FIG. 2 illustrates a graph of driving waveforms applied to electrodes respectively for driving PDP according to a related art.
Figure 3:
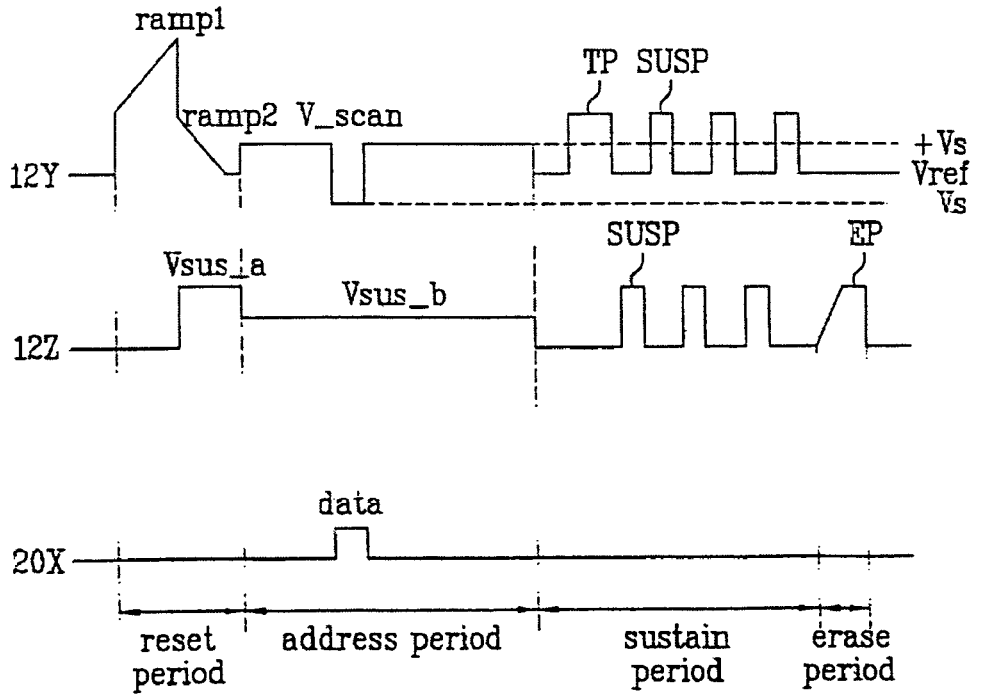
FIG. 3 illustrates a graph of driving waveforms applied to the respective electrodes for a PDP driving according to a first embodiment of the present invention.
Figure 4:
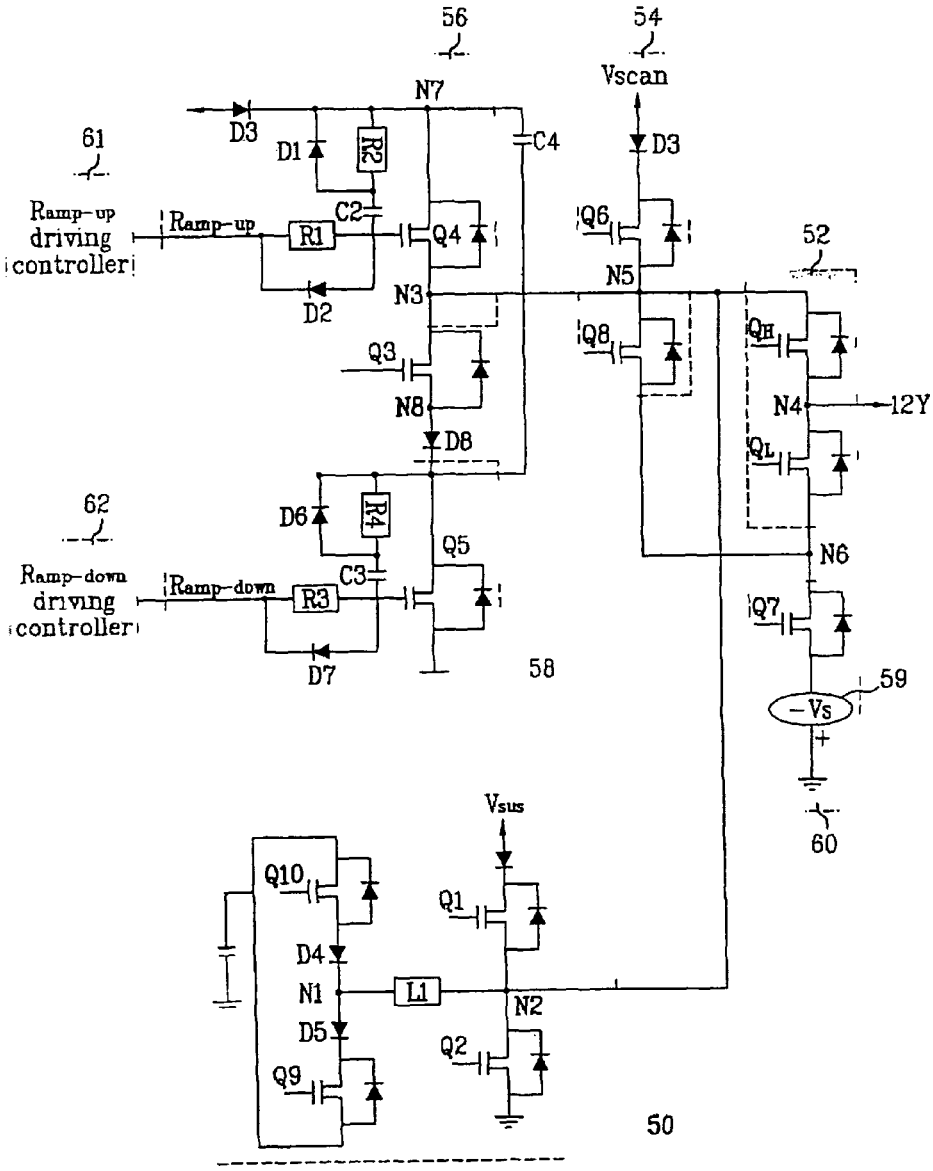
FIG. 4 illustrates a diagram of a driving circuit of a scan electrode for a PDP driving according to the present invention.
Figure 5:
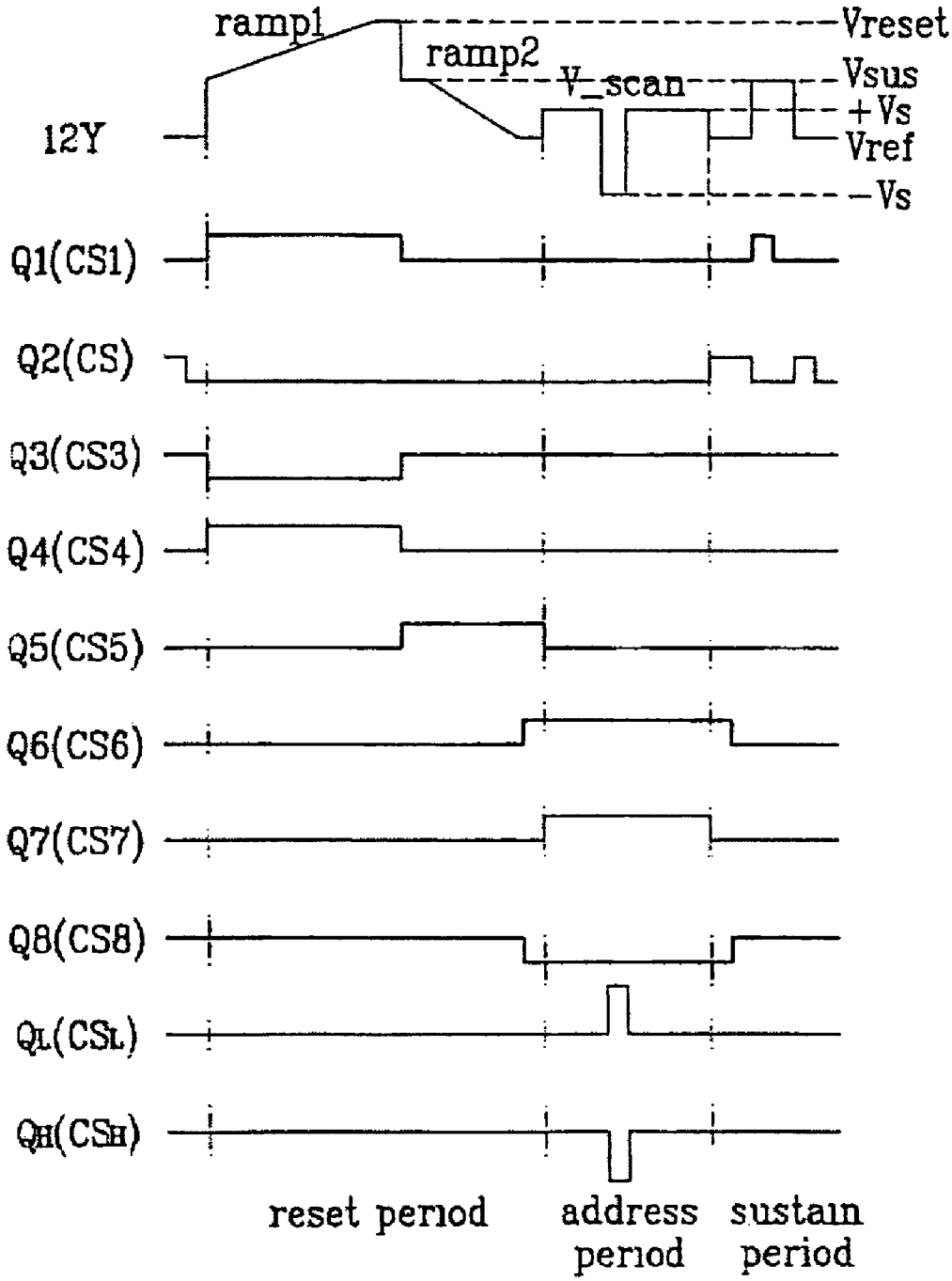
FIG. 5 illustrates a timing diagram of generating waveforms of a scan electrode according to the present invention.

FIG. 3 illustrates a graph of driving waveforms applied to the respective electrodes for a PDP driving according to a first embodiment of the present invention, FIG. 4 illustrates a diagram of a driving circuit of a scan electrode for a PDP driving according to the present invention, and FIG. 5 illustrates a timing diagram of generating waveforms of a scan electrode according to the present invention.

The present invention relates to a driving system of PDP equipped with at least three electrodes(scan electrode, sustain electrode, address electrode), in which a driving time for expressing a specific gray scale of a single frame in a 3-electrodes AC surface discharge type PDP is divided into a plurality of sub-fields.

And, each of the sub-fields is divided again into a rest period, an address period, and a sustain period for time.

In a general PDP driving, pulses of which count is determined by each of the periods of the respective sub-fields are applied to the respective electrodes with a predetermined frequency.

More specifically during the rest period, a single reset pulse is applied to a scan electrode 12Y so as to generate a reset discharge for the entire discharge cells. Therefore, all the discharge cells are initialized.

During the address period, a scan pulse SP is applied to the scan electrode 12Y sequentially as well as a data pulse DP synchronized with the scan pulse SP is applied to an address electrode 20X, whereby the address discharge is generated from the discharge cells to which the scan pulse SP and data pulse DP are applied.

During the sustain period, sustain pulses SUSPs are applied to the scan and sustain electrodes 12Y and 12Z alternately, whereby a sustain discharge is maintained for a predetermined time in the discharge cells from which the address discharge has been generated.

And, the count of the sustain pulses SUSPs increases according to the corresponding sub-field so as to display an image with the determined gray scale.

Referring to FIG. 3, a reset period is divided into a set-up period and a set-down period. In the set-up period, an ascending ramp wave ramp1 is supplied to a scan electrode 12Y, while a descending ramp wave ramp2 is supplied to a scan electrode 12Y.

During the set-up period, a weak reset discharge is generated by the ascending ramp wave ramp1 so that wall charges are accumulated in the cell.

During the set-down period, wall charges in a cell are properly erased in part by the descending ramp wave ramp2 so as to be reduced as helping a following address discharge as well as prevent a wrong discharge. Besides, in order to reduce the wall charges, a pulse having a positive (+) DC voltage Va is applied to a sustain electrode 12Z during the set-down period.

Against the sustain electrode 1Z supplied with the pulse of the positive DC voltage Va, the scan electrode 12Y supplied with the descending ramp wave ramp2 becomes negative (−) Thus, inversion of the polarities makes the wall charges, which were generated from the set-up period, are reduced.

Thus, in the reset period, ramp waves for making the entire cells of PDP uniform are supplied to the scan electrode 12Y so as to generate the reset discharge.

During the address period, an address discharge is generated by a pulse of a scan voltage V_scan applied to the scan electrode 12Y and a data pulse applied to the address electrode 20X. The address discharge enables to maintain the previously generated wall charges for a period of other discharge cells to be addressed. In this case, the pulse of the scan voltage V_scan swings centering on a reference potential Vref. Namely, a polarity of the scan voltage V_scan is inversed for one period. And, the reference potential Vref is a lowest voltage level in the reset and sustain discharges.

In other words, the pulse of the scan voltage V_scan, in which a positive voltage +Vs higher than the reference potential Vref and a negative voltage −Vs lower than the reference voltage Vref swing for one period centering on the reference potential Vref of the reset and sustain discharges, is applied to the scan electrode 12Y during the address period. At the same moment, data pulse synchronized with the pulse of the scan voltage V_scan and having the same pulse width is applied to the address electrode 20X so as to generate an address discharge. In this case, a voltage level of the data pulse is lowered as much as the negative voltage −Vs of the pulse of the scan voltage V scan.

For instance, when the reference potential Vref of the reset discharge is a ground potential, the pulse of the scan voltage V_scan is supplied by being lowered from the positive level to the negative level for the ground potential.

Thus, compared to the case that a lower limit of the scan voltage V_scan us the ground potential level in the related art, the pulse is applied in a manner that the scan voltage V_scan is lowered down to the level of the negative voltage −Vs lower than the reference potential Vref during the address period according to the present invention. Thus, the voltage level of the data pulse applied to the address electrode 20X for the address discharge is lowered. Namely, the voltage level of the address discharge voltage applied to the address electrode 20X is reduced, which is explained in the following Formula 2.

[Formula 2]

$V_{address} > V_{fy\text{-}a} - (V_{w,d} + V_{w,y}) - V_s$, where $V_{address}$, $V_{w,d}$, $V_{fy\text{-}a}$, $V_{w,y}$, and $V_s$ are a address voltage, a wall voltage accumulated on the address electrode 20X, a discharge initiating voltage between the address and scan electrodes 20X and 12Y, a wall voltage accumulated on the scan electrode 12Y, and a voltage applied to the scan electrode 12Y by an external voltage supply, respectively.

In Formula 2, providing that a minimum point of the scan voltage V_scan, as shown in FIG. 3, is tied to the ground voltage level, the discharge initiating voltage $V_{f,y-a}$ is expressed by the data voltage applied to the address electrode 20X only.

Thus, in addition to the discharge initiating voltage as a difference voltage between the scan and address electrodes 12Y and 20X, the wall voltage is added to the voltage applied to the scan electrode 12Y for the address discharge. Namely, the address discharge is generated from the voltage level resulted by adding the wall voltage having been formed in the reset discharge to the voltage difference between the scan voltage pulse applied to the scan electrode 12Y and the data pulse applied to the address electrode 20X.

The discharge voltage (=data pulse voltage) applied to the address electrode 20X for the address discharge is lowered as much as the negative voltage −Vs applied to the scan electrode 12Y.

Besides, when a lower limit of the scan voltage V_scan supplied during the address period is lowered to the level of the negative voltage −Vs lower than the reference potential Vref of the sustain discharge, a wrong discharge may occur between the scan and sustain electrodes 12Y and 12Z. In order to prevent such a wrong discharge, the present invention supplies the sustain electrode 12Z with a voltage Vsus_b of which level is lower than that of a reset voltage Vsus_a in the reset period.

In other words, in order to reduce the wall voltage so as to prevent the wall voltage formed during the reset period from generating the wrong discharge as well as help a following address discharge, the pulse of a DC voltage Va having a positive polarity (+) applied to the sustain electrode is more lowered during the address period. Namely, the voltage level of the pulse of the DC voltage Va having the positive polarity + applied to the sustain electrode is lowered as much as the voltage −Vs of the positive polarity (−) of the pulse of the scan voltage V_scan applied to the scan electrode during the following address period.

Constitution and operation of an apparatus according to the present invention are explained as follows.

FIG. 4 illustrates a diagram of a driving circuit of a scan electrode for a PDP driving according to the present invention.

Referring to FIG. 4, a scan electrode driving circuit is installed in PDP including scan, sustain, and address electrodes, and driven in accordance with reset, address, and sustain periods for time.

The scan electrode circuit according to the present invention includes a scan driving IC (integrated circuit) 52 supplying a scan electrode 12Y with an input voltage, an energy recovery unit 50 recovering a voltage discharged from the scan electrode 12Y to use, a first scan voltage supplying unit 54 supplying the scan driving IC 52 with a positive scan voltage V_scan higher than a reference potential Vref of reset and sustain discharges, a second scan voltage supplying unit 60 supplying the scan driving IC 52 with a negative scan voltage V_scan lower than the reference potential Vref of reset and sustain discharges, and set-up and set-down voltage supplying units 56 and 58 connected to the scan driving IC 52 by leaving a predetermined switch Q3 therebetween so as to supply ramp waves, respectively.

The scan driving IC 52 includes switches $Q_H$ and $Q_L$. connected to each other by 'push-pull'. The scan driving IC 52 supplies the scan electrode 12Y with inputted positive and negative voltages. In this case, eleventh and twelfth switches $Q_H$ and $Q_L$ are installed in parallel with each other so as to leave a fourth node N4, i.e. an output node to the scan electrode, therebetween. And, the eleventh and twelfth switches are turned on when the positive and negative voltages are inputted thereto, respectively.

The scan driving IC 52 supplies the scan electrode 12Y through the fourth node N4 with the voltage supplied by the first scan voltage supplying unit 54, second scan voltage supplying unit 60, set-up voltage supplying unit 56, or set-down voltage supplying unit 58.

The energy recovery unit 50 charges the voltage recovered from the scan electrode 12Y during the sustain period, and then discharges the charged voltage. For this, the energy recovery unit 50 includes an external capacitor C1, ninth and tenth switches Q9 and Q10 connected in parallel with the external capacitor C1, an inductor L1 connected in series between a first node N1, which is an output node of the ninth and tenth switches Q9 and Q10 when the external capacitor C1 is discharged, and a second node N2 as an output node of the energy recovery unit 50, a first switch Q1 connected between a supply source of a sustain voltage Vsus and the second node N2, and a second switch Q2 connected between the second node N2 and a ground node.

Operation of the energy recovery unit is explained in detail as follows.

First, the external capacitor C1 is charged with electric charges as much as its full capacitance by recovering a predetermined voltage from the scan electrode 12Y when the sustain discharge is generated from the scan electrode 12Y. Supposed that the external capacitor C1 is charged up to the recovered Vs/2 voltage, the voltage charging the external capacitor C1 is applied to the scan driving IC 52 through the tenth switch Q10, fourth diode D4, and inductor L1 if the tenth switch Q10 is turned on. Accordingly, the scan driving IC 52 supplies the scan electrode 12Y with the Vs/2 voltage. In this case, the inductor L1 constitutes a serial LC resonance circuit together with the capacitance C in the cell, whereby the scan electrode 12Y is supplied with resonance waves.

Specifically, the first switch Q1 becomes turned on at a resonance point of the resonance wave, thereby applying the sustain voltage Vsus to the scan electrode 12Y. Hence, a sustain discharge during the sustain period is generated.

Subsequently, the first switch Q1 is turned off before another sustain pulse is applied to the sustain electrode 12Z during the sustain period. At the same moment, the ninth switch Q9 becomes turned on so as to restore the voltage discharged from the scan electrode 12Y. The external capacitor C1 is then charged with the recovered voltage.

Thereafter, when the second switch Q2 is turned on after the turn-off of the ninth switch Q9, a voltage of the scan electrode 12Y maintains the ground potential so as to end the sustain discharge.

Thus, the energy recovery unit 50 recovers the voltage discharged from the scan electrode 12Y during the sustain discharge using the external capacitor C1, and then supplies the scan electrode 12Y with the recovered voltage in the following address period. Therefore, the energy recovery unit 50 enables to reduce excessive power consumption in the discharge generated from the reset and sustain periods.

The first scan voltage supplying unit 54 includes sixth and eighth switches Q6 and Q8, and a fifth node N5 is inserted between the sixth and eighth switches Q6 and Q8. The sixth switch Q6 is connected to a power supply of the positive scan voltage Vscan, and the eighth switch Q8 is connected to the second scan voltage supplying unit 60.

If control signals of high and low states are simultaneously applied to gate terminals of the sixth and eighth switches Q6 and Q8 during the address period, respectively, the first scan voltage supplying unit 54 transfers the positive scan voltage +Vs supplied from the power supply of the positive scan voltage Vscan to the scan driving IC 52. Hence, the transferred scan voltage +Vs passes the eleventh switch $Q_H$ so as to be applied to the scan electrode 12Y through the output node N4.

The set-up voltage supplying unit 56 driven during the reset period includes a fourth switch Q4 connected between a power supply of a reset voltage Vreset and a third node N3.

The fourth switch Q4 plays a role in transferring the supplied set-up waveform ramp1 to the scan driving IC 52. A second capacitor C2 is connected to a gate terminal of the fourth switch Q4, and first and second variable resistors R1 and R2 are installed in parallel with each other so as to leave the second capacitor C2 between the first and second resistors R1 and R2. The first variable resistor R1 is connected to a ramp-up driving controller 61, and the second variable resistor R2 is connected to the power supply of the reset voltage Vreset.

First and second diodes D1 and D2 are connected in parallel to these first and second variable resistors R1 and R2, respectively so as to improve a switching speed of the ramp-up driving controller 61.

Moreover, a third diode D3 connected directly to the power supply of the reset voltage Vreset cuts off a reverse current flowing in the power supply of the reset voltage Vreset.

The above-explained set-up voltage supplying unit 56 turns on the fourth switch Q4 when the driving signal of high state is applied thereto from the ramp-up driving controller 61. In this case, the voltage provided by the power supply of the reset voltage Vreset is applied to the scan electrode 12Y with the set-up waveform ramp1 having a predetermined slope through the scan driving IC 52. And, the slope of the voltage supplied from the power supply of the reset voltage depends on an RC time constant between the first and second resistors R1 and R2 and the second capacitor C2.

And, the set-down voltage supplying unit 58 driven during the reset period includes a fifth switch Q5 connected between an eighth node N8 and a ground terminal GND.

The fifth switch Q5 plays a role in transferring the supplied set-down waveform ramp2 to the scan driving IC 52. A third capacitor C3 is connected to a gate terminal of the fifth switch Q5, and third and fourth variable resistors R3 and R4 are installed in parallel with each other so as to leave the third capacitor C3 between the third and fourth resistors R3 and R4. The third variable resistor R3 is connected to a ramp-down driving controller 62, and the fourth variable resistor R4 is connected to the power supply of the third switch Q3.

Sixth and seventh diodes D6 and D7 are connected in parallel to these third and fourth variable resistors R3 and R4, respectively so as to improve a switching speed of the ramp-down driving controller 62.

Moreover, an eighth diode D8 cuts off a reverse current flowing in the scan driving IC 52 from the set-down voltage supplying unit 58.

The above-explained set-down voltage supplying unit 58 turns on the fifth switch Q5 when the driving signal of high state is applied thereto from the ramp-down driving controller 62. In this case, the set-down voltage supplying unit 58 makes the set-down waveform ramp2 descend down to a reference potential Vref of a sustain pulse with a predetermined slope depending on an RC time constant between the third and fourth resistors R3 and R4 and the third capacitor C3.

Moreover, the third switch Q3 connected between the set-up and set-down voltage supplying units 56 and 58 responds to control signals applied from the driving controllers 61 and 62 so as to switch the voltages of the set-up and set-down waveforms ramp1 and ramp2 supplied from the scan driving IC 52.

Subsequently, the second scan voltage supplying unit 60 includes a negative scan voltage power supply 59 and the seventh switch Q7, which are installed between the ground potential GND and the scan driving IC 52.

The seventh switch Q7 becomes turned on when a control signal of high state is applied to a gate terminal from a controller (not shown in the drawing). Hence, the second scan voltage supplying unit supplies the scan driving IC 52 with the negative voltage −Vs so that the negative voltage −Vs is applied to the scan electrode 12Y.

FIG. 5 illustrates a timing diagram of generating waveforms of a scan electrode according to the present invention, and operation of the scan electrode driving circuit is explained as follows.

Referring to FIG. 5, as the first switch Q1 is turned on by a control signal CS1 in the reset period, the energy recovery unit 50 supplies the scan electrode 12Y with the sustain voltage Vsus through the scan driving IC 52.

Subsequently, as the fourth switch Q4 becomes turned on by a control signal CS4, the set-up voltage supplying unit 56 supplies the scan driving IC 52 with the voltage supplied from the power supply of the reset voltage Vreset with the set-up waveform ramp1 having a predetermined slope. The scan driving IC 52 applies the set-up waveform ramp1 to the scan electrode 12Y. In this case, the reset voltage has a slope determined by the RC time constant of the first and second variable resistors R1 and R2 and the second capacitor C2 and a charged voltage of the fourth capacitor C4. Therefore, the set-up voltage supplying unit 56 supplies the scan electrode 12Y through the scan driving IC 52 with the set-up waveform ramp1 of which highest level becomes equal to that of the reset voltage Vreset as increasing by the power supply of the reset voltage Vreset.

Then, as the fourth switch Q4 is then turned off by the control signal C54 and the third switch Q3 is turned on by the control signal CS3, a voltage of the scan electrode 12Y drops down to the sustain voltage Vsus from the reset voltage Vreset.

Subsequently, as the fifth switch Q5 is turned on by a control signal C55, the set-down voltage supplying unit 58 lowers the set-down waveform ramp2 to the reference potential Vref of the sustain pulse with a predetermined slope determined by the RC time constant between the third and fourth variable resistors R3 and R4 and the third capacitor C3 so as to supply the scan electrode 12Y with the reduced set-down waveform ramp2 through the scan driving IC 52.

As explained in the above description, the set-up waveform ramp1 in the reset period ascends up to the reset voltage Vreset with the predetermined slope, whereby the discharge fails to occur greatly in the cell as well as the required wall voltage is generated in the cell during a scanning process. And, a slope of the set-down waveform ramp2 is adjusted slowly since the energy recovery unit 50 is operating while the set-down waveform ramp2 falls down to the reference voltage Vref of the sustain pulse.

In the address period, as the sixth switch Q6 is turned on by a control signal CS6, the first scan voltage supplying unit 54 supplies the scan electrode 12Y with the positive scan voltage +Vs through the scan driving IC 52.

Next, the eleventh switch $Q_H$ is turned off by a control signal CSH synchronized with the data pulse applied to the address electrode 20X, and the seventh switch Q7 is turned on by a control signal C57 as well as the twelfth switch QL is turned on by a control signal CSL. Hence, the positive scan voltage +Vs supplied from the first scan voltage supplying unit 54 is lowered to the negative voltage −Vs provided by the negative scan voltage power supply 59 so as to be applied to the scan electrode 12Y. Namely, the scan voltage V_scan, which falls from the positive scan voltage +Vs applied to the scan electrode 12Y through the scan driving IC 52 to the negative voltage −Vs lower than the reference potential Vref of the sustain pulse, is applied to the scan electrode 12Y through the scan driving IC 52.

Thereafter, as the inner wall voltage accumulated by the wall charges in the cell is added to the voltage corresponding to the voltage difference between the data pulse and the scan voltage V_scan, the address discharge is initiated in the cell to which the data pulse is applied. In this case, in order to maintain the wall charges generated from the address discharge while other discharge cells are addressed, the seventh and twelfth switches Q7 and QL are turned off. Accordingly, the positive scan voltage V_scan is applied to the scan electrode 12Y through the turned-on sixth switch Q6 and the scan driving IC 52.

In the following sustain period, after the scan driving IC 52 has been supplied with the voltage charged in the external capacitor C1 and the resonance waveform generated from a serial LC resonance circuit constructed with the inductor L1 and capacitance C in the cell, the first and second switches Q1 and Q2 are turned on alternately so that the energy recovery unit 50 supplies the scan electrode 12Y with the sustain voltage Vsus through the scan driving IC 52.

Then, the sustain discharge is initiated selectively in the discharge cells in which the wall charges are formed sufficiently by the address discharge.

Figure 6:
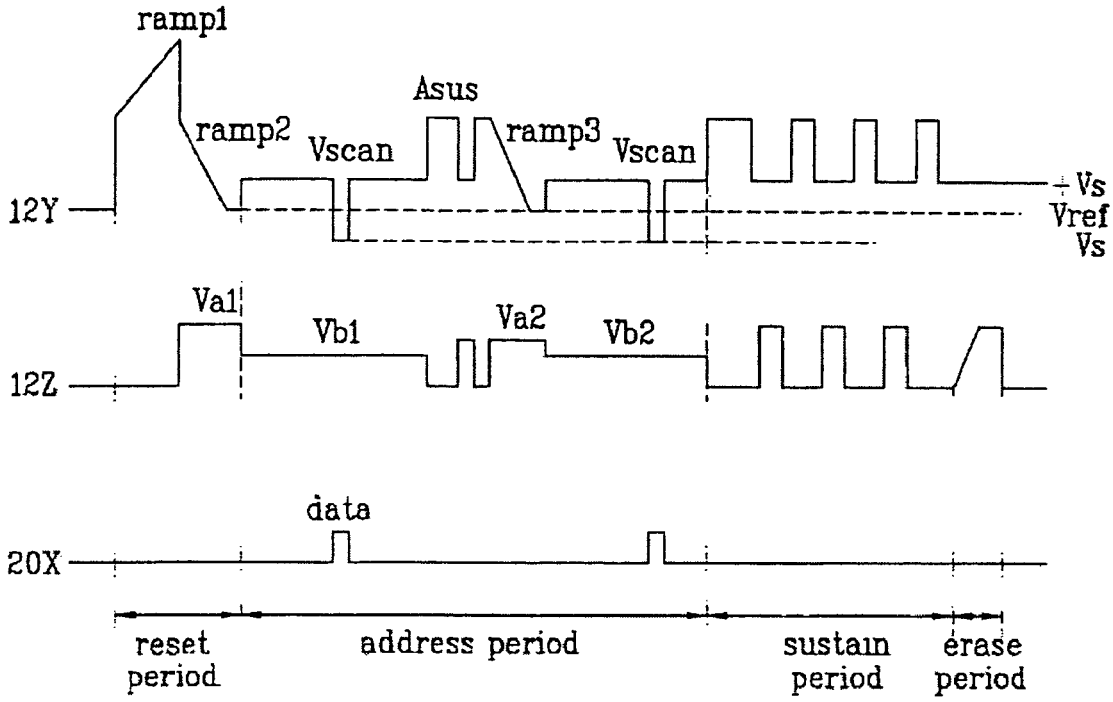
FIG. 6 illustrates a graph of driving waveforms applied to the respective electrodes for a PDP driving according to a second embodiment of the present invention.

FIG. 6 illustrates a graph of driving waveforms applied to the respective electrodes for a PDP driving according to a second embodiment of the present invention.

Referring to FIG. 6, a PDP driving according to a second embodiment of the present invention is mainly divided into a reset period initializing cells so as to equalize initial conditions of entire discharge cells, an address period selecting a discharge cell, a sustain period expressing a gray scale according to a discharge count, and an erase period erasing the discharge.

The reset period is divided into set-up and set-down periods. And, the drive of the set-up and set-down periods is explained in the foregoing description. Hereinafter, explanation for the reset period is skipped.

In the address period following the address period, centering on the reference potential Vref of the reset and sustain discharges, the scan electrode 12Y is supplied with a pulse of the scan voltage Vscan swinging between the positive voltage +Vs higher than the reference voltage Vref and the negative voltage −Vs lower than the reference potential Vref. At the same moment, the address electrode 20X is supplied with the data pulse synchronized with the pulse of the scan voltage Vscan as well as having the same pulse width of the very pulse of the scan voltage Vscan. In this case, a voltage level of the data pulse is lowered as much as the negative voltage −Vs of the pulse of the scan voltage Vscan. Thus, the address discharge is generated by the supply of the scan voltage Vscan and data pulse, whereby the discharge cells are selected.

Yet, if a lower limit of the scan voltage Vscan supplied during the address period is lowered to a level of the negative voltage −Vs lower than the reference potential Vref of the sustain discharge, a wrong discharge may be generated between the scan and sustain electrodes 12Y and 12Z. Therefore, the present invention supplies the sustain electrode 12Z with a voltage Vbi having a level lower than that of a reset voltage Val having a positive polarity(+) supplied during the reset period.

Subsequently, in order to maintain the cell selected by the address discharge, a sustain pulse Asus of which reference potential is a positive voltage +Vs is applied to the scan electrode 12Y after the pulse of the scan voltage Vscan.

Next, in order to improve a contrast ratio of the cell selected by the address discharge and sustain pulse Asus, the present invention supplies the scan electrode 12Y with a descending ramp voltage ramp3 falling down to the reference potential Vref of the reset and sustain discharges.

The reset discharge by the descending ramp voltage ramp3 erases a proper quantity of the wall charges remaining in the cells selected by other sub-fields.

In this case, a voltage Va2 of positive polarity (+) is applied to the sustain electrode 12Z so as to reduce the wall charges. Thus, the descending ramp voltage ramp3 equalizes the state of the wall charges in the cell selected by the reset and address discharges to those in the cell selected or failing to be selected by the first sub-field.

Thereafter, centering on the reference potential Vref of the reset and sustain discharges, the scan electrode 12Y is supplied with a pulse of the scan voltage Vscan swinging between the positive voltage +Vs higher than the reference voltage Vref and the negative voltage −Vs lower than the reference potential Vref. At the same moment, the address electrode 20X is supplied with the data pulse synchronized with the pulse of the scan voltage Vscan as well as having the same pulse width of the very pulse of the scan voltage Vscan. In this case, a voltage level of the data pulse is lowered as much as the negative voltage −Vs of the pulse of the scan voltage Vscan. Thus, the address discharge is generated by the supply of the scan voltage Vscan and data pulse, whereby the discharge cells are selected.

In this case, in order to prevent the wrong discharge between the scan and sustain electrodes 12Y and 12Z, the present invention supplies the sustain electrode 12Z with a voltage Vb2 of which level is lower than that of a reset voltage Va2 of positive polarity (+) supplied during the reset period.

As explained in the above description, the present invention lowers a level of the scan voltage Vscan tied to a ground level in the related art to a level of the negative voltage −Vs lower than the reference potential of the sustain pulse, thereby lowering the discharge voltage applied to the address electrode 20X for the address discharge.

Accordingly, the power consumption for the PDP drive is reduced as well as a burden of the data driving driver supplying a data pulse of high voltage level. The present invention needs no heat-dissipating plate and data energy recovery circuit using a low driving voltage additionally, thereby enabling to reduce a cost of PDP.

Moreover, the present invention equalizes the state of the wall charges selected by discharge cell to that selected or failing to be selected by the first sub-field during the address period, thereby enabling to improve a contrast ratio of the cells selected by the address discharge and sustain pulse Asus.

It will be apparent to those skilled in the art than various modifications and variations can be made in the present invention. Thus, it is intended that the present invention covers the modifications and variations of this invention provided they come within the scope of the appended claims and their equivalents.

What is claimed is:

1. A plasma display apparatus, comprising:

a plasma display panel having scan electrodes being applied reset pulse and scan pulse; and an apparatus for driving the scan electrodes in which a lowest level of the voltage applied to the scan electrodes during an address period is less than a lowest level of the voltage applied to the scan electrodes during a reset period, a highest voltage applied to the scan electrodes during the address period is positive and greater than the lowest level of the voltage applied to the scan electrodes during the reset period, a lowest level of the voltage applied to the scan electrodes during a reset period is negative, and a level of starting voltage during the sustain period is equal to a level of ending voltage during the sustain period, wherein the lowest level of a descending ramp signal applied to the scan electrode during the reset period is equal to the lowest level of the voltage applied to the scan electrode during a sustain period, and the levels of voltage applied to the scan electrode during the address period have a first level of voltage and a second level of voltage, wherein the first level of voltage is less than the lowest level of the voltage applied to the scan electrode during the sustain period, and the second level of voltage is greater than the lowest level of the voltage applied to the scan electrode during the sustain period, and is less than the highest level of the voltage applied to the scan electrode during the sustain period.

2. The apparatus of claim 1, wherein at least one ramp signal is applied to the scan electrodes during the reset period.

3. The apparatus of claim 2, wherein a ascending ramp signal is applied to the scan electrodes during set-up of the reset period, and the descending ramp signal is applied to the scan electrodes during set-down of the reset period.

4. The apparatus of claim 1, wherein a level of starting voltage applied to the scan electrodes during the reset period is substantially equal to a level of lowest voltage applied to the scan electrodes during the sustain period.

5. The apparatus of claim 1, wherein an amplitude of sustain pulse applied to the scan electrodes during a sustain period is substantially equal to an amplitude of the sustain pulse applied to the sustain electrodes during sustain period.

6. The apparatus of claim 1, wherein the lowest level of the voltage is applied to the scan electrode during the address period for a prescribed period of time, which substantially corresponds to a duration of a data signal provide on a data line to select a cell located where the scan electrode and the data line cross each other.

7. A plasma display apparatus, comprising:

a plasma display panel having scan electrodes being applied scan pulse and sustain pulse; and an apparatus for driving the scan electrodes in which a lowest level of the voltage applied to the scan electrodes during an address period is less than a lowest level of the voltage applied to the scan electrodes during a reset period and sustain period, a highest level of the voltage applied to the scan electrodes during the address period is greater than the lowest level of the voltage applied to the scan electrodes during the reset period, and a width of first sustain pulse applied to the scan electrodes is wider than that of second pulse applied to the scan electrodes during sustain period, a lowest level of the voltage applied to the scan electrodes during a reset period is negative, and a level of starting voltage during the sustain period is equal to a level of ending voltage during the sustain period, wherein the lowest level of a descending ramp signal applied to the scan electrode during the reset period is equal to the lowest level of the voltage applied to the scan electrode during the sustain period, and the levels of voltage applied to the scan electrode during the address period have a first level of voltage and a second level of voltage, wherein the first level of voltage is less than the lowest level of the voltage applied to the scan electrode during the sustain period, and the second level of voltage is greater than the lowest level of the voltage applied to the scan electrode during the sustain period, and is less than the highest level of the voltage applied to the scan electrode during the sustain period.

8. The apparatus of claim 7, wherein at least one ramp signal is applied to the scan electrodes during the reset period.

9. The apparatus of claim 8, wherein an ascending ramp signal is applied to the scan electrodes during set-up of the reset period, and the descending ramp signal is applied to the scan electrodes during set-down period in the reset period.

10. The apparatus of claim 7, wherein a lowest level of the voltage applied to the scan electrodes during the reset period is negative.

11. The apparatus of claim 7, wherein a level of starting voltage applied to the scan electrodes during the reset period is substantially equal to a lowest level of the voltage applied to the scan electrodes during the sustain period.

12. The apparatus of claim 7, wherein an amplitude of sustain pulse applied to the scan electrodes during the sustain period is substantially equal to an amplitude of sustain pulse applied to the sustain electrodes during the sustain period.

13. The apparatus of claim 7, wherein a level of the voltage applied to the sustain electrodes during the address period is less than a level of the voltage applied to the sustain electrodes during the reset period.

14. The apparatus of claim 7, wherein an amplitude of the scan pulse from the highest level to the lowest level of voltage during the address period, is substantially the same as an amplitude of the sustain pulse from the highest level to the lowest level of the voltage.

15. The apparatus of claim 7, wherein the lowest level of the voltage is applied to the scan electrode during the address period for a prescribed period of time, which substantially corresponds to a duration of a data signal provide on a data line to select a cell located where the scan electrode and the data line cross each other.

16. A plasma display apparatus, comprising:

an apparatus for driving the scan electrodes in which a lowest level of the voltage applied to scan electrodes during an address period is less than a lowest level of the voltage applied to the scan electrodes during a reset period and sustain period, a highest level of the voltage applied to the scan electrodes during the address period is greater than the lowest level of the voltage applied to the scan electrodes during the reset period and the sustain period, and a positive DC bias voltage is applied to sustain electrodes in at least one period after Ramp-up signal during the reset period, a lowest level of the voltage applied to the scan electrodes during a reset period is negative, and a level of starting voltage during the sustain period is equal to a level of ending voltage during the sustain period, wherein the lowest level of a descending ramp signal applied to the scan electrode during the reset period is equal to the lowest level of the voltage applied to the scan electrode during the sustain period, and the levels of voltage applied to the scan electrode during the address period have a first level of voltage and a second level of voltage, wherein the first level of voltage is less than the lowest level of the voltage applied to the scan electrode during the sustain period, and the second level of voltage is greater than the lowest level of the voltage applied to the scan electrode during the sustain period, and is less than the highest level of the voltage applied to the scan electrode during the sustain period.

17. The apparatus of claim 16, wherein an ascending ramp signal is applied to the scan electrodes during set-up of the reset period, and the descending ramp signal is applied to the scan electrodes during set-down period in the reset period.

18. The apparatus of claim 16, wherein a lowest level of the voltage applied to the scan electrodes during the reset period is negative.

19. The apparatus of claim 16, wherein a level of starting voltage applied to the scan electrodes during the reset period is substantially equal to a lowest level of the voltage applied to the scan electrodes during the sustain period.

20. The apparatus of claim 16, wherein an amplitude of sustain pulse applied to the scan electrodes during the sustain period is substantially equal to an amplitude of sustain pulse applied to the sustain electrodes during sustain period.

21. The apparatus of claim 16, wherein a positive voltage is applied to the sustain electrodes during the address period.

22. The apparatus of claim 16, wherein the lowest level of the voltage is applied to the scan electrode during the address period for a prescribed period of time, which substantially corresponds to a duration of a data signal provide on a data line to select a cell located where the scan electrode and the data line cross each other.

* * * * *